US006422033B2

(12) United States Patent
Ishikawa et al.

(10) Patent No.: US 6,422,033 B2
(45) Date of Patent: Jul. 23, 2002

(54) ABSORPTION TYPE REFRIGERATING APPARATUS

(75) Inventors: Mitsuru Ishikawa; Nobuyuki Yuri; Hidetaka Kayanuma, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/757,667

(22) Filed: Jan. 11, 2001

(30) Foreign Application Priority Data

Jan. 25, 2000 (JP) ..... 2000-015518
Jan. 28, 2000 (JP) ..... 2000-019854

(51) Int. Cl.[7] ..... F25B 43/04; F25B 15/00
(52) U.S. Cl. ..... 62/475; 62/476
(58) Field of Search ..... 62/474, 475, 476, 62/114

(56) References Cited

U.S. PATENT DOCUMENTS 2,320,349 A 1/1943 Cropper ..... 62/1
3,609,086 A * 9/1971 Modahl et al. ..... 252/68
4,398,399 A * 8/1983 Itoh et al. ..... 62/475
6,247,330 B1 * 6/2001 Ishikawa et al. ..... 62/475

FOREIGN PATENT DOCUMENTS

JP 5-9001 1/1993
JP 6-97127 11/1994
JP 8-121911 5/1996

OTHER PUBLICATIONS

Patent Abstracts of Japan, vol. 008, No. 118 (C–226), May 31, 1984 and JP 59 032942 A (Hitachi Seisakusho KK), Feb. 22, 1984.

* cited by examiner

*Primary Examiner*—William C. Doerrler
(74) *Attorney, Agent, or Firm*—Armstrong, Westerman & Hattori, LLP

(57) ABSTRACT

An absorption type refrigerating apparatus is provided which is capable of not discharging to the outside but, instead, oxidizes hydrogen gas generated therein to water through reaction with metal oxide to inhibit a reduction of the operational efficiency. The hydrogen gas saved in the condenser 9 is brought in direct contact with a metal oxide of the hydrogen gas removing module 93 provided in the condenser 9. This causes the reducing reaction of the metal oxide to transform the hydrogen gas to water. The module 93 of a reduction unit is accommodated in the condenser 9 thus eliminating the need of a conventional sealing structure where the reduction unit is provided outside and connected by a conduit to the condenser 9. The reducing reaction can favorably be promoted by the heat of a refrigerant vapor introduced into the condenser 9 through its inlet 94.

12 Claims, 7 Drawing Sheets

ABSORPTION TYPE REFRIGERATING APPARATUS

BACKGROUND OF THE INVENTION

1. Field of the Invention

The present invention relates to an absorption type refrigeration apparatus and particularly to an absorption type refrigerating apparatus which has a function of removing noncondensible hydrogen gas generated during the absorption refrigerating cycle operation with reducing reaction.

2. Description of the Related Art

Absorption type refrigerating apparatuses have been known for use as cooling apparatuses which are operated in an absorption refrigerating cycle. Also, as their advantage over the efficiency of energy utilization during the operation is focused, absorption type refrigerating apparatuses are increasingly demanded for carrying out a heat pump warming operation with the use of heat pumped up by an evaporator from the ambient atmosphere in addition to the cooling operation. For example, disclosed in Japanese Patent Publication (Heisei) 6-97127 is an absorption type hot/cool water supplier capable of conducting three different modes of operation; cooling, warming by heat pump action, and warming by direct burner (boiler) heating.

In the absorption refrigerating cycle of such an absorption type refrigerating apparatus, contact reaction between the contents of a refrigerant, the metal material of refrigerant conduits, and an anti-corrosion agent may generate a small amount of noncondensible gas such as hydrogen. It is said that the existence of noncondensible gas unfavorably affects the vacuum condition of the absorber or evaporator which should be maintained at as low a pressure within the range from a few mmHg to a few hundreds mmHg and thus declines the operational efficiency of the cooling and warming action. This requires an extracting means, such as a vacuum pump, for periodically carrying out a maintenance operation to discharge the noncondensible gas to the outside.

Such apparatuses for discharging the noncondensible gas from an absorption type refrigerating apparatus to the outside are disclosed in Japanese Patent Laid-open Publications (Heisei) 8-121911 and (Heisci) 5-9001. Those apparatuses allow the noncondensible gas to be separated from a refrigerant liquid and transferred into a heated palladium conduit where it is discharged to the outside by the action of selective permeability of palladium.

In an absorption type refrigerating apparatus employing an alcohol refrigerant medium, such as fluoride alcohol for operating the absorption refrigerating cycle, the refrigerant medium is mixed with water for inhibiting corrosion of the metal material of a refrigerant conduit. This, however, causes the water to react with aluminum in the refrigerant conduit material thus generating a small amount of hydrogen gas which has then to be removed.

The generation of hydrogen gas derives from the following anode and cathode reactions. The anode reaction is expressed by $A1 \rightarrow A1^3+3e$ and $A1^3+OH \rightarrow A1OOH \cdot H_2O$ (hydration of aluminum ions or deposition of a boehmite layer) and the cathode reaction is expressed by $3H+3e \rightarrow 3/2H_2$ (generation of hydrogen).

When the refrigerant medium is not of an alcohol type but is water in combination with an absorbent of lithium bromide (LiBr) or is ammonia ($NH_3$) in combination with an absorbent of water, hydrogen gas is released and has to be removed.

The noncondensible gas discharging apparatuses disclosed in the above publications have the following drawbacks. As the noncondensible gas discharging apparatuses are designed for discharging hydrogen gas to the outside, their constructions are too complex to maintain air-tightness. Also, as water in the refrigerant medium is reduced gradually, its amount required for inhibiting the corrosion can hardly be maintained.

SUMMARY OF THE INVENTION

It is an object of the present invention, in view of eliminating the above drawbacks, to provide an absorption type refrigerating apparatus capable of discharging noncondensible gas while maintaining a desired amount of water contained in the refrigerant medium without reducing the level of vacuum in the apparatus.

An example of the present invention having the first feature of this invention comprises an evaporator in which a refrigerant is stored, an absorber for absorbing a refrigerant vapor generated in the evaporator with the use of an absorbent solution, a regenerator for heating up the absorbent solution to extract the refrigerant vapor and thus recover concentration of the absorbent in the solution, and a condenser for condensing the refrigerant vapor extracted in the regenerator before transferring back the same to the evaporator, wherein the condenser has a reduction unit provided in the interior thereof for holding fundamentally a metal oxide which oxidizes hydrogen gas to water, which hydrogen gas being produced during the absorption refrigerating cycle operation.

An example of the present invention having the second feature of this invention is constructed so that the temperature of the reduction unit is maintained close to, or at least not lower than, the condensation temperature of the refrigerant.

An example of the present invention having the third feature of this invention is constructed so that the reduction unit is accommodated in a chamber of which the outer wall is of the condenser and which is fluidly communicated with the condenser for maintaining the temperature of the reduction unit close to the condensation temperature of the refrigerant.

According to these features of the present invention, the hydrogen gas acts on the oxidizing metal and is turned to water due to the reducing reaction or deoxidization of the oxidizing metal and can thus be eliminated. This inhibits the operational efficiency from being reduced with decreasing of the vacuum condition of the condenser, the evaporator, the absorber, and the refrigerant medium conduits. More particularly, water generated by the reduction is transferred to the refrigerant medium conduit, hence allowing the refrigerant medium to maintain its water content to a desired amount. As the reduction unit is mounted in the condenser, it can favorably draw heat needed for the reducing reaction from the refrigerant vapor.

In particular, as the reduction unit is provided in the condenser, its reducing reaction can be further promoted by the heat of the refrigerant vapor.

DETAILED DESCRIPTION OF THE PREFERRED EMBODIMENTS

Figure 10:
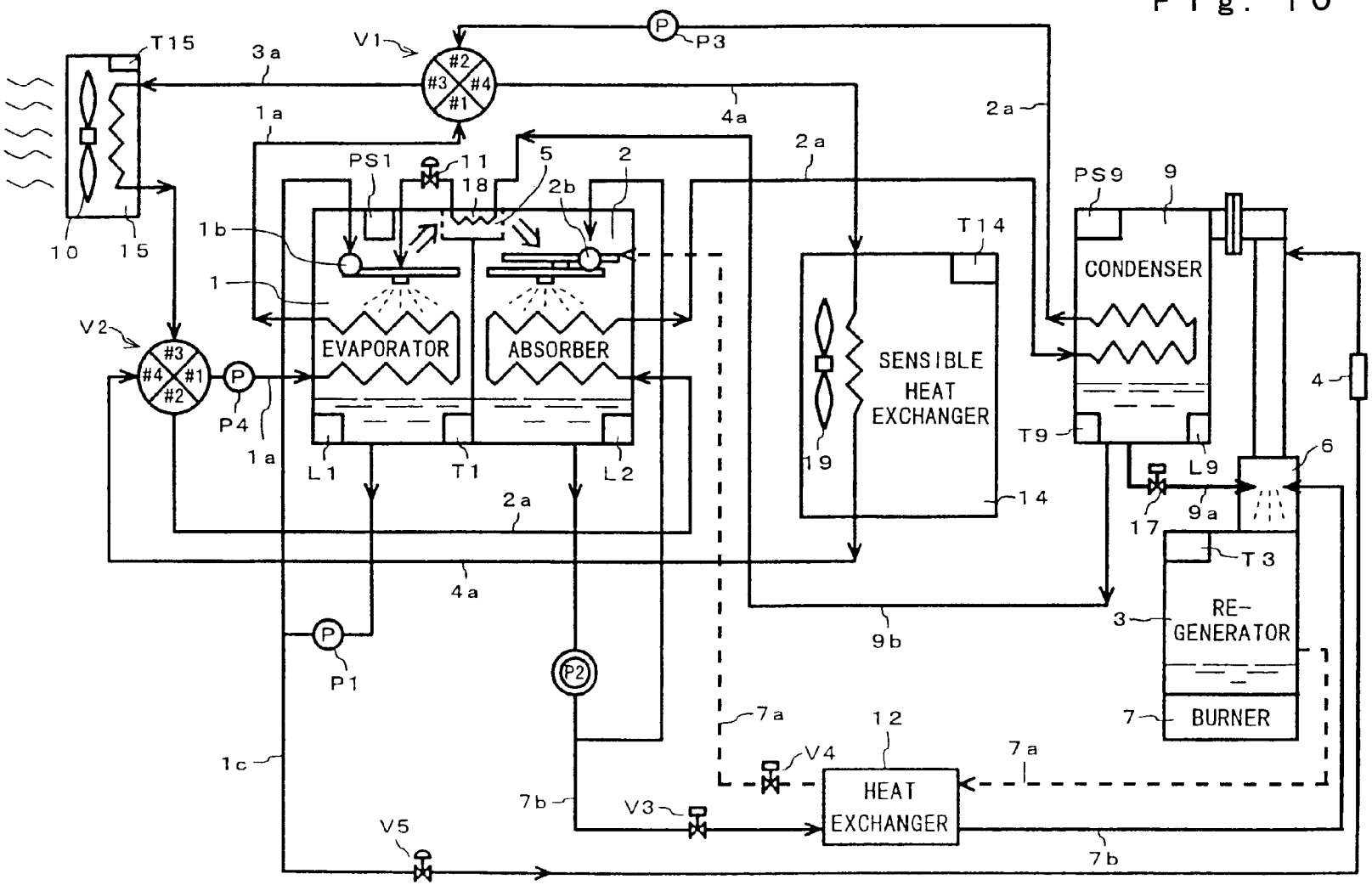
FIG. 10 is a circuitry diagram of an absorption type refrigerating apparatus showing an embodiment of the present invention.

A preferred embodiment of the present invention will be described in more detail referring to the accompanying drawings. FIG. 10 is a block diagram showing a primary part of an absorption refrigerating/heating apparatus of the embodiment of the present invention. An evaporator 1 accommodates a refrigerant of fluoride alcohol, such as trifluoroethanol (TFE), while an absorber 2 accommodates a solution of DMI derivative, such as dimethylimidazolidinon, which contains an absorbent. The refrigerant is not limited to fluoride alcohol but may be an appropriate agent of which the nonfreezing range is wide. The solution is not limited either to the DMI derivative and it maybe any other absorbent solution which is wide in the nonfreezing range, being higher than TFE in atomospheric temperature boiling point and having enough power to absorb TFE.

The evaporator 1 and the absorber 2 are fluidly communicated to each other by a (refrigerant) vapor passage 5. When the evaporator 1 is kept under a low pressure condition of e.g. 30 mmHg, the refrigerant is vaporized therein and moves via the vapor passage 5 into the absorber 2, as denoted by the double-line arrows. The refrigerant vapor is then absorbed by the absorbent in the absorber 2 thus causing an absorption freezing action.

A cooler 18 is provided for heating and evaporating a remaining mist (of the refrigerant) in the refrigerant vapor and for decreasing the temperature of the refrigerant received from the condenser 9.

When a burner 7 is lit to heat up a regenerator 3 for increasing the concentration of the absorbent solution in the absorber 2, the absorbent absorbs the refrigerant vapor in the absorber 2 and the evaporation of the refrigerant in the evaporator 1 is accelerated hence cooling down the interior of the evaporator 1 with the latent heat of the refrigerant evaporation. The burner, the regenerator, and the concentration of the absorbent solution will be described later in more detail. A tube or pipe 1*a* for passing a chilled water is mounted to run through the evaporator 1 by using a pump P4. The tube 1*a* is connected at one end (the exit side in the embodiment shown) to the No. 1 opening of a first four-way valve V1 and at the other end (the entrance side in the embodiment) to the No. 1 opening of a second four-way way valve V2. The refrigerant is fed by the action of a pump P1 to a spraying means 1*b* mounted in the evaporator 1 for being sprayed over the tube 1*a* in which the chilled water runs. The refrigerant deprives the chilled water in the tube 1*a* of heat and turns to a vapor which passes via the vapor passage 18 into the absorber 2. Consequently, the temperature of the chilled water is more reduced.

The refrigerant in the evaporator 1 is driven by the pump P1 to the spraying means and, as will be described later, its portion is passed through the filter 4 and transferred to the rectifier 6 as a vapor/liquid contact fluid (referred to as a bleed hereinafter). A flow control valve V5 is provided between the evaporator 1 and the filter 4. The chilled water running in the tube 1*a* may preferably be either an ethylene glycol or propylene glycol water solution.

As the refrigerant vapor is absorbed by the solution in the absorber 2, the absorption heat increases the temperature of the solution. The lower the temperature and the higher the concentration of the solution, the greater the absorbing capability of the solution will be. For attenuating the temperature increase of the solution, a tube 2*a* is provided in the absorber 2 for passing a flow of cooling water. The tube 2*a* is connected at one end (the exit side in the embodiment shown) via a condenser 9 and a pump P3 to the No. 2 opening of the first four-way valve V1 and at the other end (the entrance side) to the No. 2 opening of the second four-way valve V2. Preferably, the cooling water running along the tube 2*a* is the same as the chilled water which runs across the tube 1*a* in properties or constitution.

The absorbent solution is fed by the action of the pump P2 to a spraying means 2*b* mounted in the absorber 2 for being sprayed over the tube 2*a*. Consequently, the solution is cooled down by the cooling water running along the tube 2*a*. Simultaneously, the cooling water deprives the solution of heat and its temperature will increase. As the solution in the absorber 2 has absorbed the refrigerant vapor, the concentration of the absorbent drops thus lowering the absorbing capability of the solution.

The diluted solution which has absorbed the refrigerant vapor in the absorber 2 is passed via a tube 7*b* and a control valve V3 to the rectifier 6 and the regenerator 3 by the pump P2. The regenerator 3 is provided with the burner 7 for heating up the diluted solution. The burner 7 may be a gas burner or any other heating means. The solution is heated by the burner 7 and the concentration of the absorbent is increased as the refrigerant vapor is separated. The resultant (concentrated) solution is returned via a tube 7*a* and a control valve V4 to the absorber 2 where it is sprayed over the tube 2*a* by the spraying means 2*b* and pump P2.

When the diluted solution conveyed to the regenerator 3 is heated up by the burner 7, a refrigerant vapor is generated. Most of the absorbent solution is separated from the refrigerant vapor in the rectifier 6 and thus, the refrigerant vapor at a higher purity is fed to the condenser 9. The refrigerant vapor is then cooled down and condensed to a liquid in the condenser 9, and returned back via the pre-heater 18 and the reducing valve 11 to the evaporator 1. The refrigerant is sprayed over the conduit 1*a*.

Although the purity of the refrigerant fed back form the condenser 9 is fairly high in the evaporator 1, it may or must gradually be reduced because a very small amount of the absorbent in the circulated vapor is accumulated during a long period of the cycle operation. For recovering the purity of the refrigerant, a small portion of the refrigerant from the evaporator 1 is sent through the valve 5 and the filter 4 to the rectifier 6 where it is mixed with the refrigerant vapor from the regenerator 3. The filter 4 is used for preventing filler tubes of the rectifier 6 from being fouled with dirt and/or rust in the absorbent solution which may cause degradation of the functional operation.

A heat exchanger 12 is provided in the middle way of the tubes 7*a* and 7*b* which respectively connect the absorber 2 and the rectifier 6. The absorbent solution at high concentration and high temperature which runs along the tube 7*a* from the regenerator 3 is subjected to a heat exchanging action in the heat exchanger 12 with the diluted solution which runs along the tube 7*b* from the absorber 2, hence being cooled before it is fed to the absorber 2 where it is sprayed. In reverse, the diluted solution is preheated by the action of the heat exchanger 12 and passed to the rectifier 6. This will surely improve the thermal efficiency in the apparatus. In addition, another heat exchanger (not shown) maybe provided for transferring heat from the concentrated solution to the cooling water which runs along the tube 2*a* from the absorber 1 or the condenser 9. Accordingly, the temperature of the concentrated solution returned to the absorber 2 will be reduced further while the temperature of the cooling water will be increased.

A sensible heat exchanger 14 is also provided with a tube 4*a* for heat exchange between the cooling water or the chilled water and the outside air and an indoor unit 15 is provided with a tube 3*a*. The tubes 3*a* and 4*a* are connected at one end (the entrance side in the embodiment shown) to the No. 3 and No. 4 openings of the first four-way valve V1, respectively, and at the other end (the exit side) to the No. 3 and No. 4 openings of the second four-way valve V2, respectively. The indoor unit 15 is located in a room to be cooled or heated and includes a fan 10 used in common for blowing out either cooling air and heating air from its blowing window (not shown). The sensible heat exchanger 14 is normally placed in the outdoor and includes a fan 19 for forcedly exchanging heat with the outside air.

The evaporator 1 is provided with a level sensor L1 for detecting the amount of the refrigerant and a temperature sensor T1 for detecting the temperature of the refrigerant. The absorber 2 is equipped with a level sensor L2 for detecting the amount of the solution. The condenser 9 is provided with a level sensor L9 for detecting the amount of condensed refrigerant, a temperature sensor T9 for detecting the temperature of the refrigerant, and a pressure sensor PS9 for detecting the pressure in the condenser 9.

The sensible heat exchanger 14 is provided with a temperature sensor T14 for detecting the temperature of the outside air. The indoor unit 15 is provided with a temperature sensor T15 for detecting the temperature of a room which is air-conditioned, and the regenerator 3 is provided with a temperature sensor T3 for detecting the temperature of the solution.

In the cooling operation, the first and the second four-directional valves V1 and V2 are actuated so that their No. 1 and No. 2 openings communicate with the No. 3 and No. 4 openings respectively. This allows the chilled water cooled down by spraying the refrigerant over the conduit 1*a* to run into the conduit 3*a* of the indoor unit 15 for cooling the room.

In the heating operation, the first V1 and the second four-directional valve V2 are switched so that their No. 1 and No. 2 openings communicate with the No. 4 and No. 3 openings respectively. This allows the cooling water heated up in the conduit 2*a* to be driven by the pump P3 into the conduit 3*a* of the indoor unit 15 for heating the room.

When the temperature of the outside air drops down to an extreme level during the heating operation, pumping the heat from the outside air by the sensible heat exchanger 14 becomes difficult hence reducing the heating capability. For compensation, a return passage 9*a* and an open/close valve 17 are provided in a combination for bypassing between the condenser 9 and the regenerator 3 (or the rectifier 6). As the pumping of the heat from the outside air has become hard, the absorption and refrigeration cycle is ceased and the vapor generated by the regenerator 3 is circulated to and from the condenser 9. In the condenser 9, the heat produced with the burner 7 is efficiently transferred by the direct heat-up operation to the cooling water in the conduit 2*a*, thus improving the heating capability.

A hydrogen gas removing module provided in the cooling/warming system is now explained. The hydrogen gas removing module is provided in the interior or on the inner wall of the condenser. More particularly, a reduction unit, which is a main component of the hydrogen gas removing module, is so located that its temperature rises close to the condensation temperature of the refrigerant vapor introduced into the condenser. When the metal oxide in the reduction unit is exposed to the refrigerant medium, it is covered with a layer of the refrigerant medium and its area of contact with hydrogen will be decreased thus lowering the capability of eliminating hydrogen. For inhibiting the declination, the reduction unit is designed for increasing its temperature close to the condensation temperature. More specifically, when the refrigerant vapor is higher than the condensation temperature, it remains noncondensible thus ensuring a higher capability of eliminating the hydrogen gas.

Figure 11:
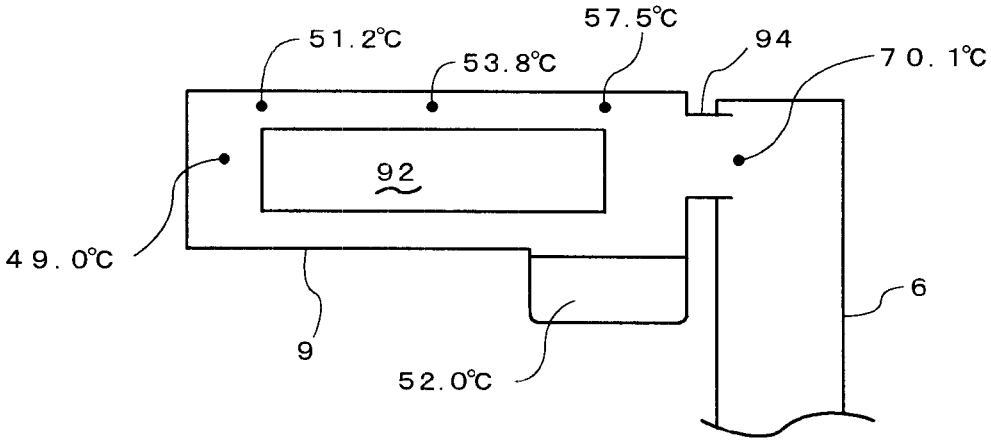
FIG. 11 is a diagram showing different levels of the temperature at particular locations in the condenser.

FIG. 11 is a diagram showing different levels of the temperature in the condenser during the cooling operation. As shown, the temperature in the condenser 9 exhibits its highest at the reception inlet 94 for receiving the refrigerant vapor from the rectifier 6 and becomes lower as distanced from the inlet 94. In any location, the temperature is not substantially lower than 50° C. The refrigerant medium deposited on the bottom of the condenser 9 is at 52° C. while the condensation temperature of TFE as the refrigerant medium is 53° C.

Figure 1:
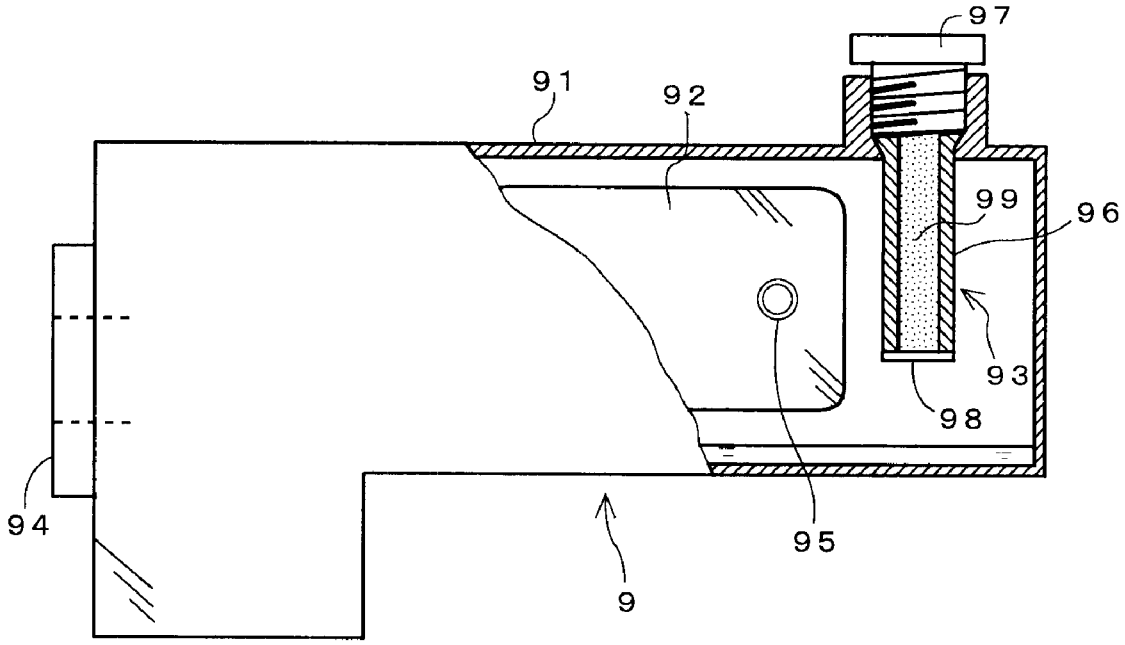
FIG. 1 is a partial cross sectional view showing a primary part of the condenser in a first embodiment of the present invention.

FIG. 1 is a cross sectional view of the condenser accompanied with the hydrogen gas removing module. As shown, the condenser 9 comprises a casing 91, a core 92 mounted in the casing 91, and a reduction unit provided next to the core 91 for serving as the hydrogen gas removing module 93. The casing 91 has a refrigerant vapor inlet 94 provided in one end thereof for receiving the refrigerant vapor induced from the rectifier 6. The core 92 comprises a plurality of sheet metal (fins) and a pipe 95 extending through the fins. The pipe 95 is provided as a portion of the conduit 2*a* which incorporates a passage of the cooling water.

The hydrogen gas removing module 93 as the reduction unit comprises a tube 96 extending from the upper side of the casing 91 to the interior of the condenser 9 and a cap 97 threaded into a thread provided at the opening in the casing 91 where the tube 96 is fitted into. The tube 96 is secured to the casing 91 and closed at the upper end by the cap 97 being threaded into the opening. A mesh or a (net-like) filter 98 is mounted to the lower end of the tube 96. The tube 96 supported at the lower end by the filter 98 is filled with a powder or granule form of metal oxide 99.

The metal oxide 99 may be a single oxide of transition metal or a mixture of transition metal oxides. Characteristic examples of the metal oxide 99 are NiO and an NiO-based mixture with CuO, $MnO_2$, and $Al_2O_3$. Also, a mixture containing at least one of CuO, $MnO_2$, and $Al_2O_3$ as the main component may be equally be used.

In operation, hydrogen gas H2 which is generated during the absorption refrigerating cycle and saved in the condenser 9 is brought in direct contact with the metal oxide 99 in the tube 96 through the filter 98. As a result, the reduction or deoxidization of the metal oxide 99 takes place thus producing water and eliminating the hydrogen gas. More specifically, the chemical reaction is commenced as expressed by $MOX+XH_2=M+XH_2O$ . . . (f1) where M is a transition metal and X is a constant.

As the hydrogen gas saved in the condenser 9 has been brought in contact with the metal oxide 99 and oxide to water, the hydrogen gas eliminating action hardly causes a declination in the amount of water contained in the refrigerant medium which runs along the refrigerant medium conduits. Accordingly, the water contained in the refrigerant medium for corrosion inhibiting the metal material of the refrigerant medium conduits can be maintained to a desired amount. When lithium bromide or ammonia is used as the refrigerant, water is used as the absorbent liquid and will thus rarely affect the absorption refrigerating cycle operation with $H_2$ gas turned to water.

As shown, the hydrogen gas removing module 93 is mounted in the condenser 9 as spaced from the refrigerant vapor inlet 94 and can avoid the efficiency of reduction from being reduced due to the metal oxide 99 moistened by the refrigerant medium. Because the refrigerant vapor introduced is mostly condensed at the location distanced from the refrigerant vapor inlet 94, it will hardly develop its deposited layer over the metal oxide 99.

Figure 2:
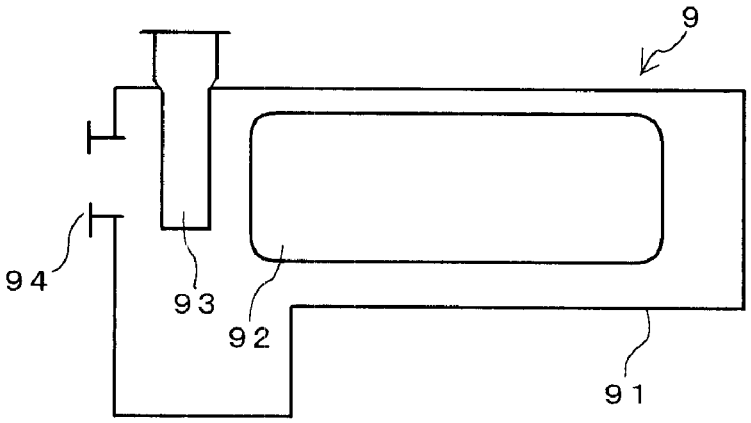
FIG. 2 is a schematic cross sectional view showing a modification of the condenser of the first embodiment.

The installation of the hydrogen gas removing module 93 is not limited to the location shown in FIG. 1. FIG. 2 is a schematic view of the condenser 9 with modified location of the hydrogen gas removing module 93. In the modified location, the hydrogen gas removing module 93 is installed close to the refrigerant vapor inlet 94. As the hydrogen gas removing module 93 is instantly exposed to the refrigerant vapor introduced and thus maintained at a comparatively higher temperature, its metal oxide 99 can remain at the temperature suited for the reduction.

Figure 3:
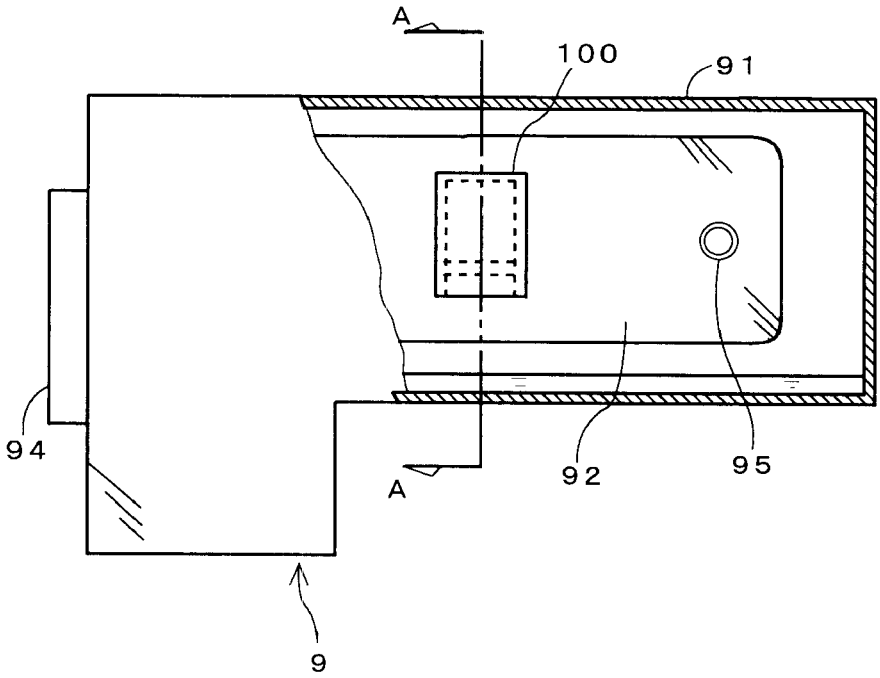
FIG. 3 is a partial cross sectional view showing a primary part of the condenser in a second embodiment of the present invention.
Figure 4:
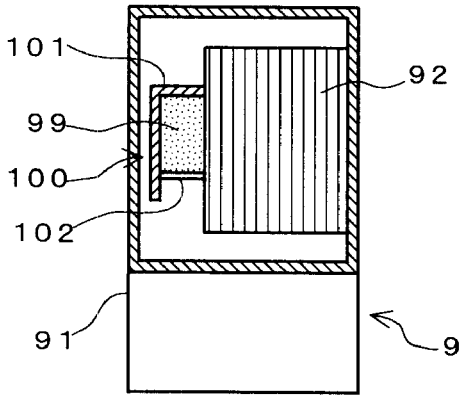
FIG. 4 is a view taken along the line A—A of FIG. 3.

Another form of the hydrogen gas removing module is now explained. FIG. 3 is a cross sectional view of the condenser 9 having a second embodiment of the hydrogen gas removing module. FIG. 4 is a view taken along the line A—A of FIG. 3. As shown in FIGS. 3 and 4, the hydrogen gas removing module 100 is mounted to the core 92. The hydrogen gas removing module 100 comprises a shell 101 fixedly mounted to the most outward one of the fins of the core 92, a filter 102 provided at a lower opening side of the shell 101, and a metal oxide 99 held in a space defined by the shell 101 and the filter 102. The first modification permits heat to be directly transmitted from the core 92 heated up by the refrigerant vapor to the shell 101 and thus the metal oxide 99 held in the shell 101 of the hydrogen gas removing module 100. As a result, the metal oxide 99 can consistently receive from the core 92 an amount of heat energy for promoting the reduction.

Figure 5:
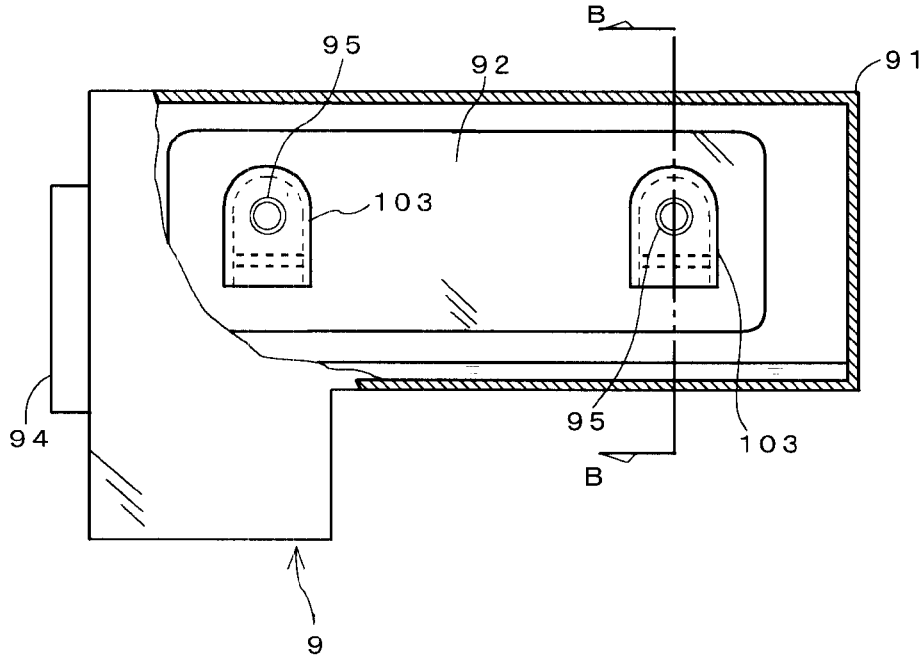
FIG. 5 is a partial cross sectional view showing a primary part of the condenser in a third embodiment of the present invention.
Figure 6:
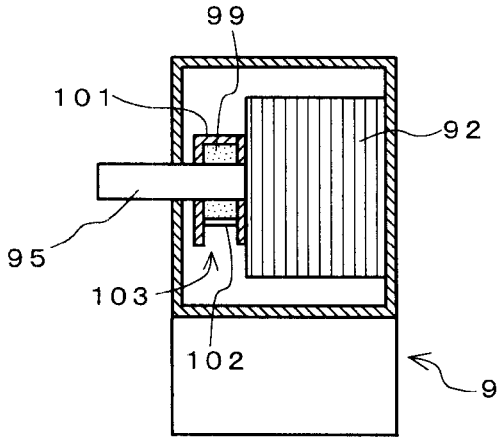
FIG. 6 is a view taken along the line B—B of FIG. 5.

FIG. 5 is a cross sectional view of the condenser 9 having a third embodiment of the hydrogen gas removing module and FIG. 6 is a view taken along the line B—B of FIG. 5. As shown in FIGS. 5 and 6, two of the hydrogen gas removing modules 103 are provided. Each hydrogen gas removing module 103 has a shell 101 thereof provided about a pipe 95 which is a part of the cooling water conduit, more specifically, the pipe 95 extending across the shell 101. The second modification allows a combination of the heat of the refrigerant vapor and the heat received via the pipe 95 from the core 92 heated by the refrigerant vapor to maintain the shell 101 and thus the metal oxide 99 held in the shell 101 of the hydrogen gas removing module 103 to an appropriate temperature.

Figure 7:
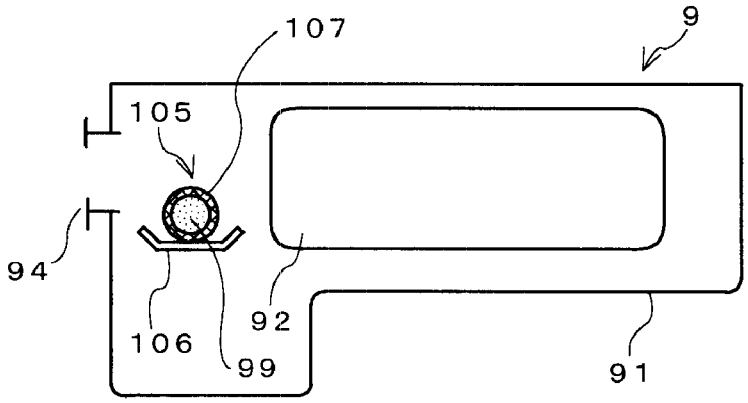
FIG. 7 is a cross sectional view of a condenser showing the fourth embodiment.

FIG. 7 is a schematic cross sectional view showing a fourth embodiment of the condenser 9. In the fourth embodiment, a hydrogen gas removing module 105 is provided on a support plate 106 which is horizontally mounted to a casing 91 of the condenser 9 and comprises a metal oxide 99 and a mesh or a filter 107 holding the metal oxide 99 therein. As the support plate 106 is located between the refrigerant vapor receiving inlet 94 and a core 92, it is exposed to the refrigerant vapor of a higher temperature similar to that shown in FIG. 2.

Figure 8:
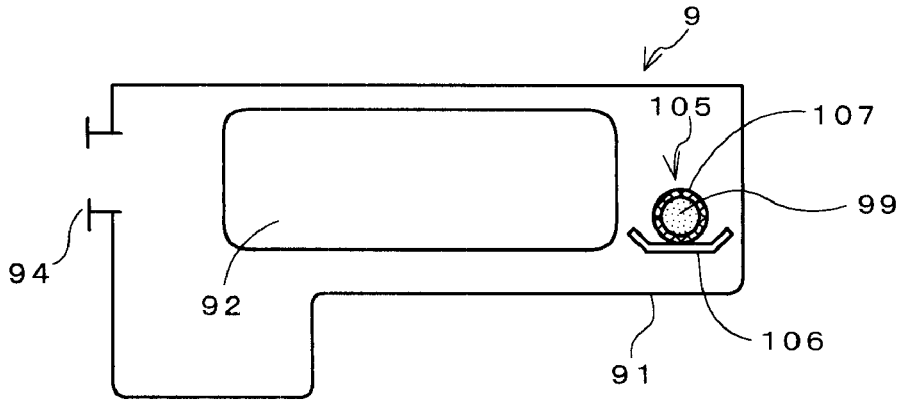
FIG. 8 is a cross sectional view of a condenser showing the fifth embodiment.

FIG. 8 is a schematic cross sectional view showing a fifth embodiment of the condenser 9. The fifth embodiment like the fourth embodiment has the hydrogen gas removing module 105 disposed in a deep region of the condenser 9 or at the furthest location from the refrigerant vapor receiving inlet 94. In the fifth embodiment, as the refrigerant vapor when condensed hardly reaches the deep region of the condenser 9 where the hydrogen gas removing module 105 is located, similar to that shown in FIG. 1, it permits the metal oxide 99 to be free from wetting and prevented from being declined in the reducing capability.

Since the hydrogen gas removing module 105 shown in FIGS. 7 or 8 is favorably accommodated together with the support plate 106 for supporting the metal oxide in the condenser 9, the casing 91 of the condenser 9 stays not intricate. Accordingly, it will be easy to maintain the airtightness of the casing 91.

Figure 9:
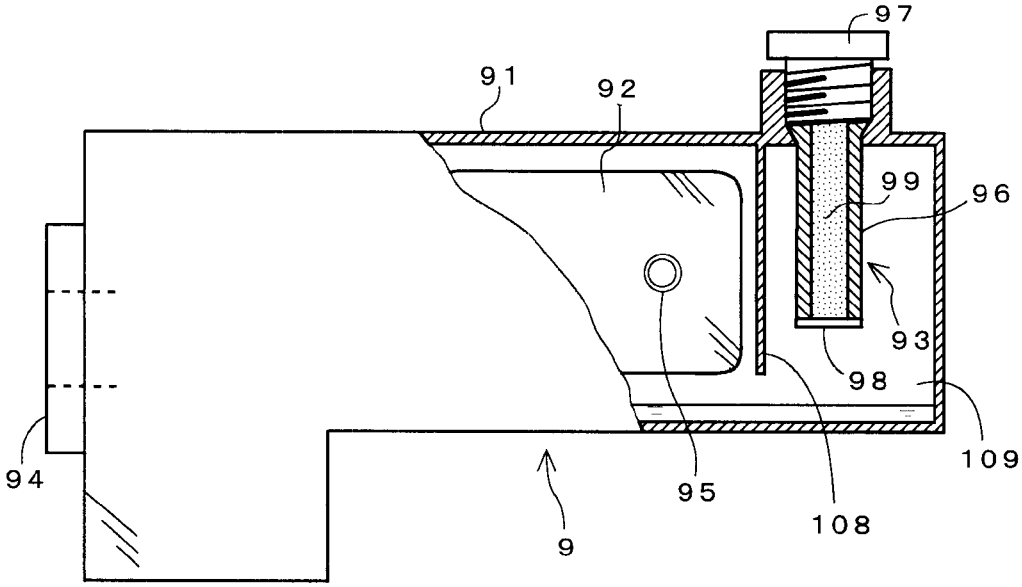
FIG. 9 is a partial cross sectional view of a primary part of a condenser showing the sixth embodiment.

FIG. 9 is a cross sectional view showing a sixth embodiment of the condenser 9. According to each of the previous examples, the hydrogen gas removing module is provided in the interior of the condenser 9. In other words, the hydrogen gas removing module is arranged adjacent to, or directly next to, the core or the cooling water conduit in the space where the core or cooling conduit is provided. In the sixth embodiment, the hydrogen gas removing module is accommodated in a chamber which is separated from the space where the core or cooling water conduit is provided. As shown in FIG. 9, the hydrogen gas removing module 93 is separated by a partition 108 from the core 92. The partition 108 has an opening provided in a lower region thereof for communicating between the interior of the condenser 9 and the chamber 109 where the hydrogen gas removing module 93 is provided. This allows hydrogen gas saved in the condenser 9 to flow from the opening of the partition 108 to a filter 98 and come into contact with the metal oxide 99 of the hydrogen gas removing module 93.

Figure 12:
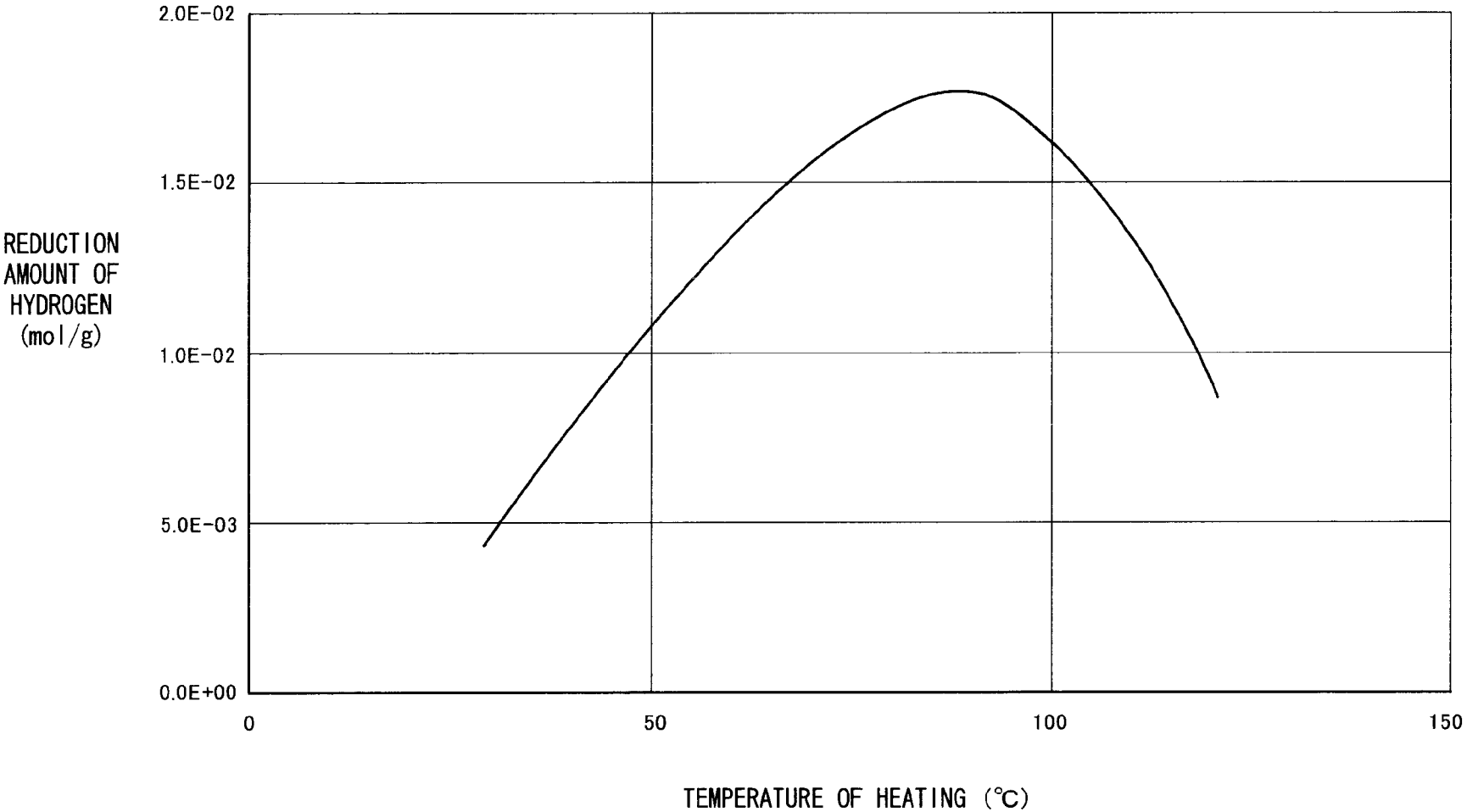
FIG. 12 is a diagram showing the relationship between the temperature at the reduction unit and the reduction amount of hydrogen.

The advantage that the metal oxide 99, when placed in the atmosphere of at least a temperature higher than the condensation temperature of the refrigerant vapor, enables improvement of its reducing reaction with the help of heat of the vapor in the condenser 9 will be apparent from the following profile. FIG. 12 is a graph showing the relationship between the temperature of heating the metal oxide and the reduction amount of hydrogen. As shown, when the temperature of heating the metal oxide is in a range from 40 to 120° C., the reduction amount of hydrogen is as high as $1.0\times10^{-2}$ mol/g or more. Its peak appears at substantially 80° C. As it is described above that the condensation temperature of TFE is normally 53° C., the reducing reaction for eliminating hydrogen can be guaranteed by the metal oxide maintained at least at the condensation temperature or higher.

The present invention is not limited to the foregoing embodiment where a powder form or a granule form of the metal oxide 99 is filled in the tube 96 or the shell 101. For example, the metal oxide 99 may be in the form of a sintered layer provided on the outer surfaces of the tube 96 or the shell 101 for ease of direct contact with hydrogen gas. In that case, the tube 96 or the shell 101 maybe formed of a hollow rod or a plate.

The surfaces of the rod or plate carrying the metal oxide layer may be waved or undulated to increase their overall surface area. The metal oxide of a single substance as described previously may be doped with a catalyst adder, such as palladium or its compound ($PdCl_2$) or platinum or its compound, for promoting the reaction between the metal oxide and the hydrogen gas.

As set forth above, the absorption type refrigerating apparatus of the embodiment allows the hydrogen gas saved in the condenser 9 during the operation to come in direct contact with the metal oxide 99 held in the hydrogen gas removing module and be turned to water by the reduction. Accordingly, the hydrogen gas can successfully be eliminated. The reduction will favorably be promoted by the action of heat from the refrigerant vapor introduced at a higher temperature from the rectifier.

As apparent from the above description, according to the present invention, the hydrogen generated during the cycle operation of the absorption type refrigerating apparatus can be eliminated as turned to water by the reduction of the metal oxide. This inhibits the vacuum state in the refrigerant medium conduits from being reduced, hence ensuring a higher level of the operational efficiency. Also, the water generated is not discharged to the outside of the apparatus and its amount contained in the refrigerant medium can hence be maintained to a desired amount.

Since its reduction unit is provided in the condenser, the absorption type refrigerating apparatus does not require a conventional intricate sealing arrangement where the reduction unit is located outside and connected by a conduit to the condenser and permits heat of the refrigerant medium introduced in to the condenser to be directly utilized for promoting the reduction. In particular, according to an aspect of the invention, the metal oxide in the reduction unit is favorably protected from being wetted with the refrigerant vapor. According to another aspect of the invention, the efficiency of the reduction can be increased by the action of the refrigerant vapor at a high temperature. According to yet another aspect of the invention, the heat of the core exposed constantly to the refrigerant vapor can be utilized in addition to the heat received directly from the refrigerant vapor. According to a further aspect of the invention, the heat of the cooling water conduit exposed to the refrigerant vapor can be utilized in addition to the heat received directly from the refrigerant vapor.

As apparent from the foregoing description, according to the present invention, the reduction unit holding the metal oxide is heated close to, or not lower than, the condensation temperature of the refrigerant medium, thus successfully eliminating or reducing hydrogen to water. This permits the vacuum condition in the refrigerant medium conduits to remain not reduced hence improving the operation efficiency. Also, as the water generated by the reduction is not discharged to the outside, the amount of water contained in the refrigerant medium can be maintained to a desired level.

In particular, the invention permits the reduction unit to be provided in the interior of, or closely joined to, the condenser, hence, eliminating the need of a conventional complex sealing structure where the reduction unit is provided outside and connected by a conduit to the condenser. Also, the reduction unit can be heated up to a desired temperature for the reduction directly by heat of the refrigerant medium vapor introduced into the condenser. By means of the invention, the metal oxide in the reduction unit can be protected from being wetted by the refrigerant vapor. Furthermore, the reducing action can be increased in the efficiency by high temperature energy of the refrigerant vapor.

Moreover, the reduction unit is implemented by the metal oxide enclosed simply in a mesh material.

What is claimed is:

1. An absorption type refrigerating apparatus having an evaporator in which a refrigerant is stored, an absorber for absorbing a refrigerant vapor generated in the evaporator with the use of an absorbent solution, a regenerator for heating up the absorbent solution to extract the refrigerant vapor and thus recover a concentration of the absorbent in the solution, and a condenser for condensing the refrigerant vapor extracted in the regenerator before transferring back the same to the evaporator, wherein the condenser has a reduction unit provided within the interior thereof, said reduction unit holding fundamentally a metal oxide which oxidizes hydrogen gas to water, and means for conducting which hydrogen gas being produced during the absorption refrigerating cycle operation into contact with said metal oxide.

2. An absorption type refrigerating apparatus according to claim 1, wherein the condenser has a casing provided with an inlet at one side for receiving refrigerant vapor from the regenerator, and the reduction unit is located on a side of the casing interior opposite to the one side containing the inlet in the condenser.

3. An absorption type refrigerating apparatus according to claim 1, wherein the condenser has a casing provided with an inlet at one side for receiving refrigerant vapor from the regenerator, and the reduction unit is located within the casing adjacent to the side thereof containing the refrigerant vapor inlet.

4. An absorption type refrigerating apparatus according to claim 1, wherein the condenser has core sheets within the interior thereof for condensing the refrigerant vapor, and the reduction unit being mounted closely adjacent to the core sheets.

5. An absorption type refrigerating apparatus according to claim 1, wherein the condenser has core sheets within the interior thereof for condensing the refrigerant vapor, and a cooling water conduit fixedly joined to the core sheets, and the reduction unit being mounted closely adjacent to the cooling water conduit.

6. An absorption type refrigerating apparatus having an evaporator in which a refrigerant is stored, an absorber for absorbing a refrigerant vapor generated in the evaporator with the use of an absorbent solution, a regenerator for heating up the absorbent solution to extract the refrigerant vapor and thus recover a concentration of the absorbent in the solution, and a condenser for condensing the refrigerant vapor extracted in the regenerator before transferring back the same to the evaporator, wherein a reduction unit is provided for holding fundamentally a metal oxide which oxidizes hydrogen gas to water, which hydrogen gas being produced during the absorption refrigerating cycles operation, and the temperature of the reduction unit being maintained close to, or at least not lower than, the condensation temperature of the refrigerant.

7. An absorption type refrigerating apparatus according to claim 6, wherein the reduction unit is accommodated in a chamber of which the outer wall is a wall of the condenser, said chamber being fluidly communicated with the condenser.

8. An absorption type refrigerating apparatus according to claim 6, wherein the reduction unit is provided in the interior of the condenser.

9. An absorption type refrigerating apparatus according to claim 6, wherein the condenser has a casing provided with an inlet at one side for receiving refrigerant vapor from the regenerator, and the reduction unit is located on a side of the casing interior opposite to the one side containing the inlet in the condenser.

10. An absorption type refrigerating apparatus according to claim 6, wherein the condenser has a casing provided with a an inlet at one side for receiving the refrigerant vapor from the regenerator, and the reduction unit is located within the casing adjacent to the side thereof containing the refrigerant vapor inlet.

11. An absorption type refrigerating apparatus according to claim 9, wherein the reduction unit comprises a mesh material and a metal oxide enclosed in the mesh material.

12. An absorption type refrigerating apparatus according to claim 10, wherein the reduction unit comprises a mesh material and a metal oxide enclosed in the mesh material.

* * * * *